US010571132B2

(12) United States Patent
Soohoo et al.

(10) Patent No.: US 10,571,132 B2
(45) Date of Patent: Feb. 25, 2020

(54) HIGH TEMPERATURE FOOD PREPARATION DEVICE

(71) Applicant: Town Food Service Equipment Co., Inc., Brooklyn, NY (US)

(72) Inventors: David Soohoo, Brooklyn, NY (US); Davor Pavlovich, Brooklyn, NY (US)

(73) Assignee: TOWN FOOD EQUIPMENT CO., INC., Brooklyn, NY (US)

( * ) Notice: Subject to any disclaimer, the term of this patent is extended or adjusted under 35 U.S.C. 154(b) by 821 days.

(21) Appl. No.: 13/866,336

(22) Filed: Apr. 19, 2013

(65) Prior Publication Data

US 2014/0216439 A1 Aug. 7, 2014

Related U.S. Application Data

(60) Provisional application No. 61/762,055, filed on Feb. 7, 2013.

(51) Int. Cl.
*F24C 15/08* (2006.01)
*F24C 3/08* (2006.01)

(52) U.S. Cl.
CPC ..... *F24C 3/085* (2013.01)

(58) Field of Classification Search
CPC ... F24C 15/10; F24C 3/085; F24C 1/16; A47J 27/04; A47J 36/20; A47J 37/0704
See application file for complete search history.

(56) References Cited

U.S. PATENT DOCUMENTS 3,606,066 A * 9/1971 Anderson ..... A47J 37/0704 126/25 C
4,076,008 A * 2/1978 Deaton ..... A47J 37/00 126/25 R
5,284,126 A * 2/1994 Varney ..... F24C 1/16 126/29
5,400,700 A * 3/1995 Bois ..... A47J 37/1209 219/436
6,103,291 A * 8/2000 Fernandez Tapia .... A47J 27/04 220/912
6,718,967 B2 * 4/2004 Luther ..... F24C 15/10 126/30
2012/0145144 A1 * 6/2012 Lin ..... F24J 2/02 126/617
2012/0298094 A1 * 11/2012 Lin ..... F24C 15/34 126/1 F

FOREIGN PATENT DOCUMENTS

AU 2009201248 B2 * 5/2010 ..... F24C 15/10

OTHER PUBLICATIONS

LUUS Combined Ref, webpage: http://www.luus.com.au/waterlesswok.html, dated Feb. 7, 2009.*
Sydney Water (2006) The Waterless Wok Stove Information Sheet. PDF.*

* cited by examiner

*Primary Examiner* — Jason Lau
(74) *Attorney, Agent, or Firm* — Alston & Bird LLP

(57) ABSTRACT

The high-temperature food preparation device of the present invention is an air-cooled high-temperature food preparation device that may be used in a large number of cooking methods and styles. Specifically, the present invention consists of a chassis, a range top, a heat source, and a support structure positioned above the heat source. The support structure is comprised of a tubular chamber insulator, a support ring, and a suspension structure. The support structure may be removably mounted above the heat source.

6 Claims, 3 Drawing Sheets

HIGH TEMPERATURE FOOD PREPARATION DEVICE

This application claims the benefit of priority of U.S. Provisional Application No. 61/762,055 filed on Feb. 7, 2013 which is incorporated by reference herein in its entirety.

FIELD OF INVENTION

The present invention generally relates to a high-temperature food preparation device, and in particular, concerns an air-cooled high temperature food preparation device that may be used in a large number of cooking methods and styles of cooking

BACKGROUND OF THE INVENTION

Certain traditional cooking requires intense heat to cook quickly and sear food. For example, high-temperature food preparation devices are used to subject food to intense heat for stir frying, steaming, pan frying, boiling, braising, poaching, searing, stewing, or roasting. This type of cooking is generally accomplished using specially designed heating ranges adapted for use with multiple cooking units such as a wok or cooking pot. Typical cooking devices consist of a chassis, a range top, a heat source, and at least one support structure above the heat source that may be specially designed to accommodate cooking equipment such as a pot or work.

Operating typical cooking devices such as a wok range results in heat transfer from the range's heating sources to the range top. High-temperature ranges can operate at temperatures that can exceed 2,100° F., resulting in the support structure exceeding temperatures of 500° F. In traditional high-temperature ranges, the support structure is in direct contact with the range top and/or heating source. Because of this contact, heat can be conducted through the support structure to the range top. As a consequence, the range top of a high-temperature range is subjected to a significant amount of heat while the range is in use. The amount of heat fluctuates as the high-temperature range is turned on and off, which can occur many times during typical operation. Range tops that are subjected to high temperatures can experience accelerated fatigue and warping; this reduces the operative lifespan of a high-temperature range. The high temperatures of a range top also pose a physical risk to operators of high-temperature cooking ranges who may receive severe burns by contact with the range top.

Accelerated fatigue and wear is not limited solely to the range top, but experienced by other components of high-temperature ranges as well. This results in the need to frequently service and repair components of high-temperature ranges that are damaged by the significant heat. Traditional high-temperature ranges include support structures that are welded directly to the range top or chassis of the cooking device, make necessary service and maintenance difficult, time-consuming, and costly.

There are several known devices which use high-temperature ranges specifically for high-temperature cooking For example, one type of high-temperature cooking device includes wok cooking ranges. Wok cooking is characterized by applying high heat to a wok, a specialized metal cooking pan that may include a convex bottom used to quickly cook and sear food. High-volume high-temperature cooking as might occur in a restaurant, for example, may employ a specially designed cooking range with multiple cooking stations. A high-temperature wok cooking range usually includes multiple cooking stations, with each cooking station consisting of a support structure that rises from a heat source through a range top that is penetrated by the cooking stations of the range. In traditional wok cooking ranges, the support structure is directly in contact with the range top or chassis of the cooking device.

The burners in these wok ranges generate a massive amount of heat. If left unchecked, the wok range will eventually warp like a pretzel. To overcome this, a continuous flow of water is directed across the range top. This water usage requires a large amount of resources and raises regulatory and economic issues due to the high volumes of water needed over the course of operating the range. A high-temperature cooking range that includes two cooking stations adapted to wok cooking may use in excess of 3,500 liters of water each day to cool the range top, which results in significant costs. For example, in some areas of the country water usage associated with high-temperature cooking ranges has been estimated to $6,000 a year. Thus, a high-temperature cooking range can add substantially to the cost and water usage of a restaurant.

Further, in traditional high-temperature cooking ranges the support structure is directly joined with the high-temperature cooking ranges, making maintenance difficult, time-consuming, and costly. For example, in some traditional high-temperature cooking ranges the support structure is welded directly to the range top, while in other traditional high-temperature cooking ranges, components of the heating source pass through the support structure. Either configuration requires dismantling of portions of the high-temperature cooking range to perform repairs or routine service.

Other high-temperature ranges adapted to wok cooking use air rather than water to cool the range top. An example of an air-cooled wok cooking range includes the WL model series sold by LUUS Industries Pty Ltd. of Australia. With air-cooled high-temperature cooking devices, the range top is separated from the support structure so that air may circulate between the range top and the support structure. These ranges, however, have a gap between the support structure and the range top posing certain problems. This gap allows food, cooking materials, and debris to fall into the space between the range top and the support structure. This space can be difficult to access, and any food or debris that falls into this space would be difficult to remove, posing hygiene issues and difficulties in meeting public food safety regulations. This space also increases the risk of fires because the space between the range top and the support structure becomes very hot. Inability to access this space and remove debris raises the risk that material that falls into this area may catch fire, damaging the high-temperature range, and endangering users. Further, the heat source and support structure are mounted directly to the chassis of the cooking device. As a consequence of this design, heat is transferred from the support structure, through the chassis of the cooking device, to the range top. The materials used in the support structure also increase heat transfer to the range top. The support structure in an air-cooled wok cooking range is often composed entirely of metal such as cast iron or steel, which is a very efficient heat conductor. This results in significant heating of the range top. Also, because the support structure is welded directly to the chassis of the cooking device, service and maintenance of the cooking device can be difficult, time-consuming, and costly.

Another example of an air-cooled wok cooking range includes the Bistro Range model series sold by a California company, Jade Range LLC. The Bistro range series includes support structures that are made of stainless steel and are directly welded to the range top. As in the WL model series described above, the Bistro ranges have a gap between the support structure and the range top that allows food, cooking materials, and debris to fall into the space between the range top and the support structure. Further, the support structures are mounted directly to the range top of the cooking device. As a consequence of this design, heat is transferred from the support structures to the range top. The stainless steel used in the support structures also increases heat transfer to the range top because stainless steel is a very efficient heat conductor. Also, because the support structures are welded directly to the chassis of the cooking device, service and maintenance of the cooking devices can be difficult, time-consuming, and costly.

The present invention has overcome the problems present in traditional cooking ranges. That is, the high temperature food preparation devices of the present invention comprise an air-cooled high temperature food preparation device that includes a removable support structure that minimizes contact between the support structure and the range top. Without intending to be bound by any mechanism of action, as a result of this configuration, limited heat passed or conducted to the range top is significantly limited, thus reducing water usage, allowing kitchens to satisfy food safety regulations, decreasing the risk of fire, minimizing the chance of users being burned, and allowing for the support structure to be easily removed from the cooking device to facilitate service and maintenance.

The advantages of some embodiments of the present invention include, without limitation, a high-temperature range with no direct contact between the hot elements of a high-temperature range (the chamber insulator and the support ring) and the range top. The clips of the suspension structure provide limited contact between the hot elements of the range and the range top. This dramatically decreases heat conduction from the chamber insulator and support ring to the range top, and results in a reduced heat load on the range top. The reduced heat load decreases fatigue on the range top material and extends the lifespan of the high-temperature range. The reduced temperature of the range top is also safer for operators of the high-temperature range because they are less likely to burn themselves on a hot range top.

Another advantage of some embodiments of present invention is that it does not require the use of water to cool the range top of the high-temperature range. Because water is no longer needed to cool the range top, operators of the described invention will save considerable amounts of money and resources.

Another advantage of some embodiments of the present invention is that it requires less operation of a water valve and water line used to periodically clean the range top. In prior art examples, water is used to clean and cool the range top of a high-temperature range. Because water is no longer needed to cool the range top, the valve and water supply line is not used as often, which prolongs the lifespan of these components.

Another advantage of some embodiments of the present invention is that it protects against food, cooking materials, or debris from falling into the space between the support structure and the range top. Because the perimeter of the support ring is greater than the perimeter of the circular opening in the range top through which the support structure passes through, there is limited space for water or debris to pass between the support structure and the range top.

Another advantage of some embodiments of the present invention is that the support structure may be removably mounted to the range top of a high-temperature food preparation device. This allows for the support structure to be easily removed from the food preparation device to facilitate service and maintenance of the food preparation device, and decreases the risk of food, cooking materials, or debris from becoming lodged beneath the range top.

SUMMARY OF THE INVENTION

The present invention overcomes the problems of the food preparation devices of the prior art by, in part, minimizing the heat transferred from the heat source to the surface of the food preparation device, thus eliminating the need to direct running water over the range top. A particular preferred embodiment of the present invention embraces the "Insul-Gap" Technology which isolates the heat producing and retaining components from the range top by utilizing a unique structure to suspend a support structure over a heat source, resulting in minimal contact between the range top and the support structure. A particular preferred embodiment of the present invention also includes support structures which are easily removable, thus improving access to the internal components of the food preparation device for maintenance.

A particular preferred embodiment of the invention is a high-temperature food preparation device comprising a chassis; a range top mounted to said chassis, the range top having at least one opening; a heat source mounted to said chassis; and a support structure removably positioned in the at least one opening of the range top wherein said support structure is in contact with the range top.

Another particular preferred embodiment of the invention may include a suspension structure further comprising a tubular chamber insulator with a wall of a thickness of between about 0.03 and about 2 inches, the tubular chamber insulator having two ends with an outer perimeter that is less than that of the at least one opening in the range top; a support ring received on the top end of the tubular chamber insulator that extends above the range top, the perimeter of the support ring is greater than that of the at least one circular opening in the range top; a suspension structure having a series of clips that extend parallel to the longitudinal axis of the tubular chamber insulator, wherein the series of clips are in contact with the range top and at least the tubular chamber insulator or the support ring, and wherein the support ring is above said range top when said support structure is removably positioned within the opening of the range top.

Another particular preferred embodiment of the invention may include a suspension structure further comprising a strap that laterally encircles the tubular chamber insulator.

Another particular preferred embodiment of the invention may include a suspension structure comprising three clips that are substantially equidistant.

Another particular preferred embodiment of the invention may include a suspension structure that is in direct contact with the support ring and the range top.

Another particular preferred embodiment of the invention may include a suspension structure further comprising a strap that laterally encircles the tubular chamber insulator.

Another particular preferred embodiment of the invention may include a suspension structure further comprising a circular flange that is in contact with the bottom edge of the tubular chamber insulator.

Another particular preferred embodiment of the invention may include a suspension structure that is in direct contact with the tubular chamber insulator and the range top.

Another particular preferred embodiment of the invention may include a suspension structure further comprising a circular flange that is in contact with a portion of the bottom end of the tubular chamber insulator.

Another particular preferred embodiment of the invention may include a tubular chamber insulator and the support ring that are integrated.

Another particular preferred embodiment of the invention may include a tubular chamber insulator and support ring that are integrated and composed of the same material.

Another particular preferred embodiment of the invention is a removable support structure for use with a high-temperature food preparation device comprising a tubular chamber insulator with a wall of a thickness of between about 0.03 and about 2 inches, a top end, and bottom end; a support ring received on the top end of the tubular chamber insulator, the outer perimeter of said support ring is greater than that of the outer perimeter of the top end of the tubular chamber insulator; a suspension structure having a series of clips that extend parallel to the longitudinal axis of the tubular chamber insulator, wherein the series of clips are in contact with at least the tubular chamber insulator or the support ring, and wherein when the support structure is removably connected to a high-temperature food preparation device, the suspension structure is in contact with the high-temperature food preparation device.

Another particular preferred embodiment of the invention may include a removable support structure with a suspension structure further comprises a strap that laterally encircles the tubular chamber insulator.

Another particular preferred embodiment of the invention may include a removable support structure with a suspension structure comprising three clips that are substantially equidistant.

Another particular preferred embodiment of the invention may include a removable support structure with a suspension structure that is in direct contact with the support ring and the range top.

Another particular preferred embodiment of the invention may include a removable support structure with a suspension structure further comprising a strap that laterally encircles the tubular chamber insulator.

Another particular preferred embodiment of the invention may include a removable support structure with a suspension structure further comprised of a circular flange that is in contact with at least a portion of the bottom end of the tubular chamber insulator.

Another particular preferred embodiment of the invention may include a removable support structure with a suspension structure that is in direct contact with the tubular chamber insulator and the range top.

Another particular preferred embodiment of the invention may include a removable support structure with a tubular chamber insulator and support ring that are integrated.

Another particular preferred embodiment of the invention may include a removable support structure with a tubular chamber insulator and support ring are composed of the same material.

BRIEF DESCRIPTION OF DRAWINGS

Having thus described the invention in general terms, reference will now be made to the accompanying drawings, which are not necessarily drawn to scale.

Figure 1:
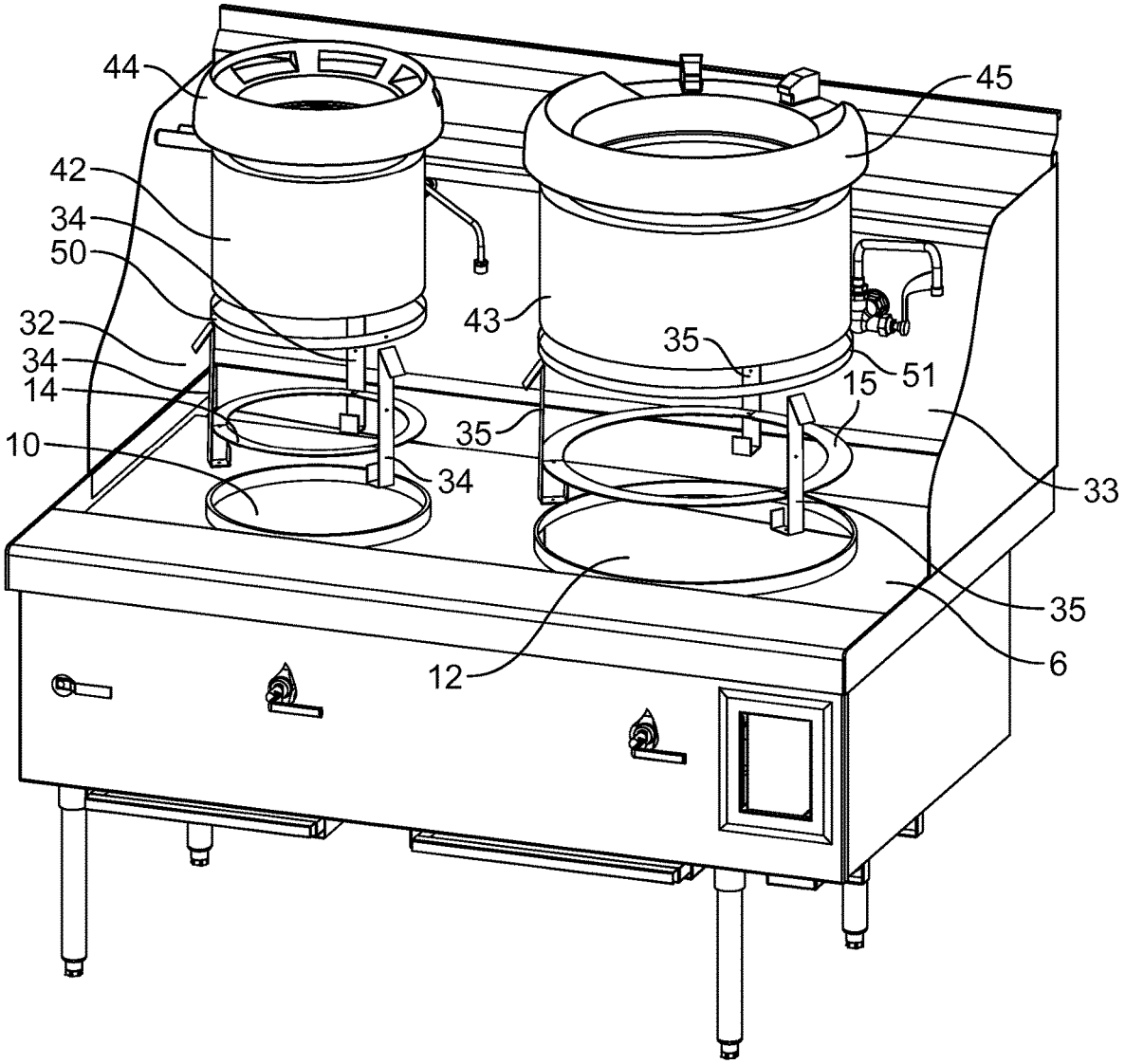

FIG. 1 is an exploded view of a high-temperature food preparation device that incorporates an embodiment of a high-temperature food preparation device of the present invention.

Figure 2:
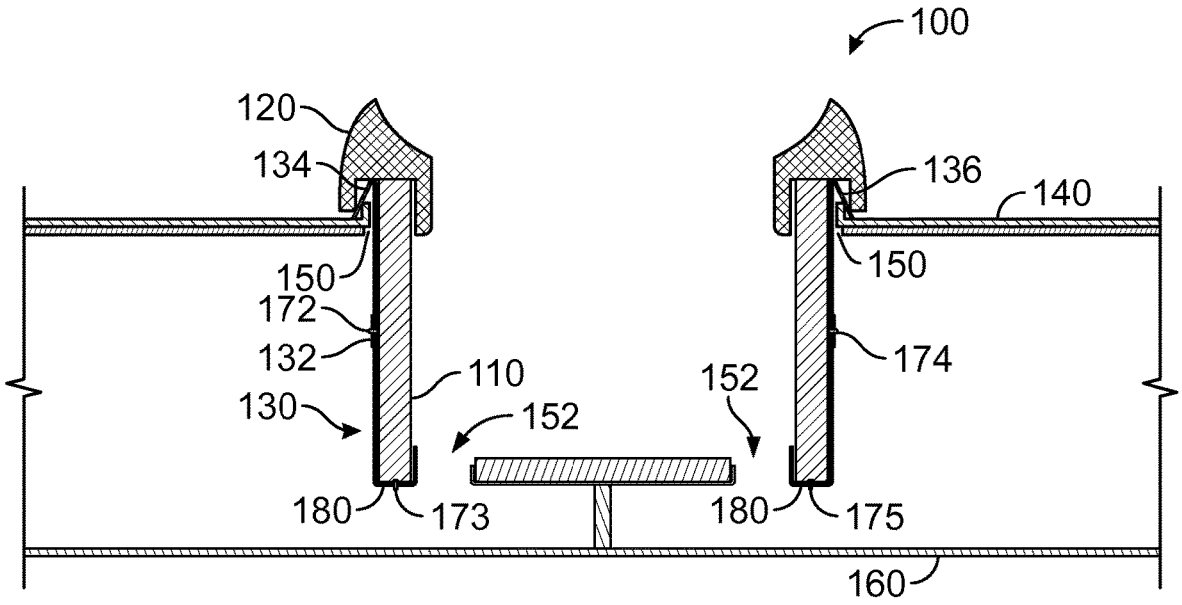

FIG. 2 is a cut away side view of a high-temperature food preparation device that incorporates an embodiment of a high-temperature food preparation device of the present invention.

Figure 2A:
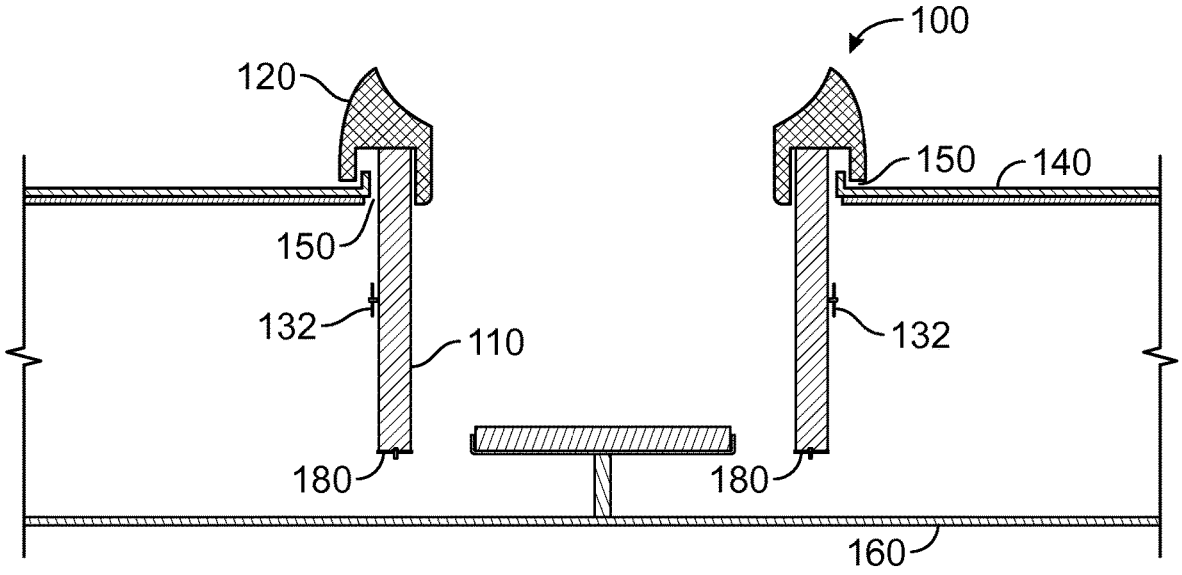

FIG. 2A is a cut away side view of a high-temperature food preparation device that incorporates an embodiment of a high-temperature food preparation device of the present invention.

Figure 3:
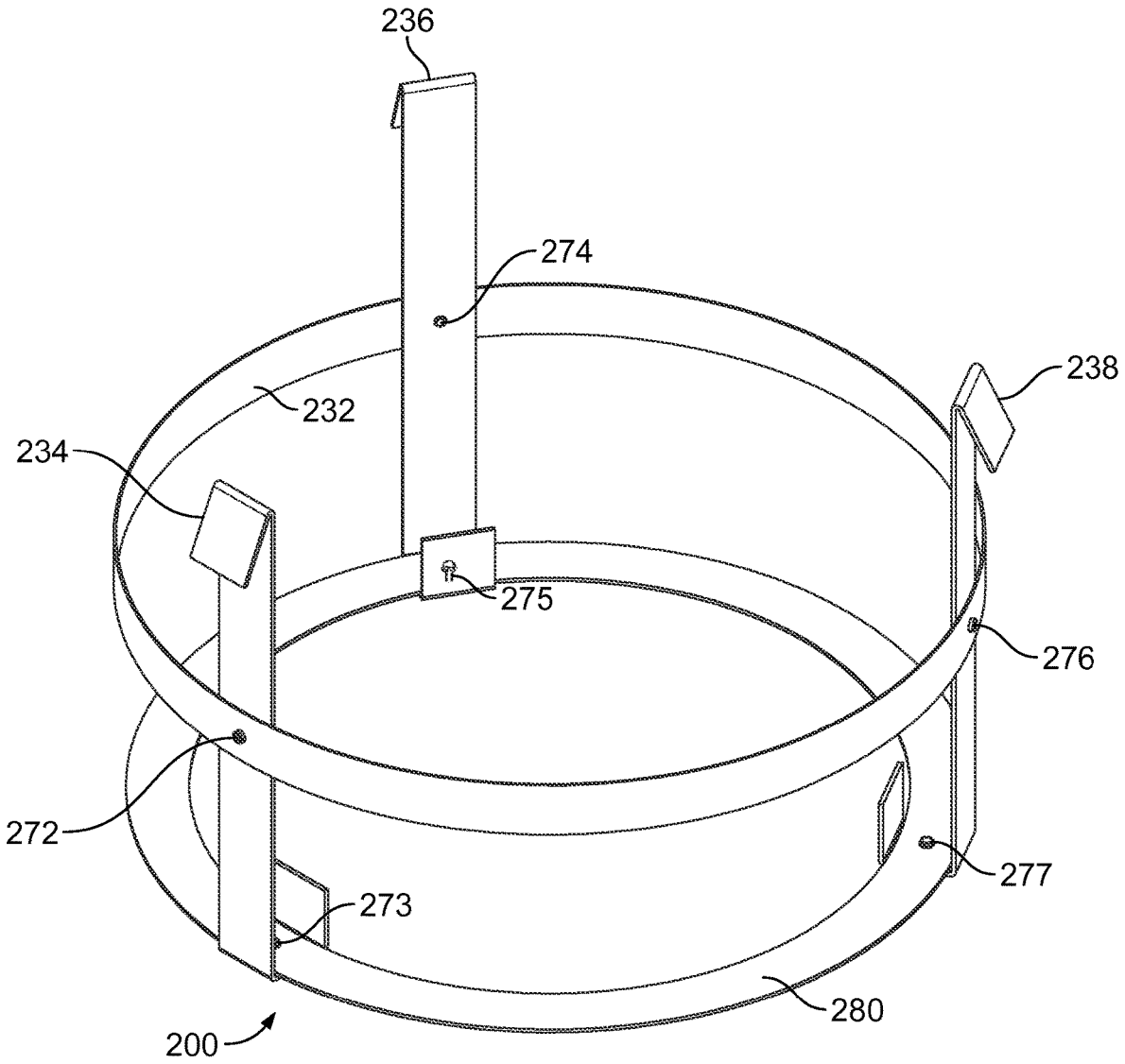

FIG. 3 is a perspective view of an embodiment of the suspension structure of the present invention.

DETAILED DESCRIPTION OF THE INVENTION

A particular embodiment of the present invention now will be described more fully hereinafter with reference to the accompanying drawings, in which some, but not all embodiments of the invention are shown. Any embodiment described is only an example of one embodiment and should not be interpreted to limit any of the claims. Like numbers refer to like elements throughout.

Generally speaking, a particular embodiment of the present invention includes a high-temperature food preparation device. More specifically, one aspect of an embodiment of the present invention is a high-temperature food preparation device comprising at least a range top, a heat source, and a removable support structure positioned generally above a heat source. In some embodiments the support structure consists of a chamber insulator, a support ring that is in direct contact with the chamber insulator, and a suspension structure that contacts the range top and at least the support ring or the chamber insulator. In some embodiments, the support ring may be modified to accommodate the particular shape of a wok or specialized cooking pot.

FIG. 1 is an exploded view of a high-temperature food preparation device that incorporates an embodiment of a high-temperature food preparation device of the present invention. The embodiment illustrated in FIG. 1 includes two high-temperature food preparation stations that are each comprised of a support structure that passes through a circular opening 10, 12 in the range top 6. Each support structure consists of a tubular chamber insulator 42, 43, a support ring 44, 45, and a suspension structure 32, 33. One end of each support structure extends above the range top 6. A heat source (not shown) is associated with each support structure.

In this embodiment, the heat source is a gas burner positioned below the support structure. Other suitable heat sources include but are not limited to infrared, electric, or induction heaters. One of ordinary skill in the art would know how to use other suitable material in accordance with the invention.

The suspension structure 32, 33 in this embodiment may include a circular flange 14, 15 that is in contact with at least a portion of the bottom edge of the tubular chamber insulator 42, 43 for support of the support ring and chamber insulator. In this example, the suspension structure also may include a strap 50, 51 that laterally encircles the tubular chamber insulator 42, 43. Each suspension structure also consists of several clips 34, 35 that extend upward, perpendicular to the strap 50, 51. Each support ring in this embodiment 44, 45 may be modified to accommodate the particular shape of a wok or cooking pot. The support structures illustrated in this embodiment may be removably mounted to the range top 6 of the food preparation device by positioning a support structure into one of the circular openings 10, 12 in the range top 6. When removably mounted to the range top of the food preparation device, each suspension structure 32, 33 is in contact with, but not joined to, the range top 6. In this embodiment, when removably mounted to the range top of the food preparation device, the clips 34, 35 are in contact with the range top 6. Further, when removably mounted to the range top of the food preparation device, the support structure 32, 33 may be separated from the range top 6 by lifting the support structure laterally upwards.

FIG. 2 is a side elevation view of a preferred embodiment of a high-temperature food preparation device. In this embodiment, a support structure 100 includes a tubular chamber insulator 110, a support ring 120, and a suspension structure 130.

The chamber insulator 110 is tubular and surrounds a heat source (not shown). In this embodiment, the heat source is mounted to the chassis 160 of the high-temperature food preparation device. The chamber insulator 110 may extend above the range top 140, but does not come into direct contact with the range top 140 or the chassis 160 of the food preparation device. The chamber insulator 110 is also isolated from the heat source (not shown) and air may pass (1) through the gap 150 between the range top 140 and chamber insulator 110 and (2) through the gap 152 between the heat source (not shown) and chamber insulator 110. Preferably, the chamber insulator 110 is made of hardy, heat-tolerant material of sufficient thickness to insulate the heat source. The chamber insulator 110 is of between about 0.03 and about 2 inches in thickness. In this particular embodiment the chamber insulator 110 is of a thickness of between about 1 and about 1.5 inches. Further, one suitable material includes fiber ceramic. Other suitable materials include but are not limited to cast iron or stainless steel. One of ordinary skill in the art would know of other suitable materials that may be used in accordance with the invention.

At least one end of the chamber insulator 110 is adapted to receive and support a support ring 120. The end of the chamber insulator 110 that extends above the range top 140 is so adapted. In this embodiment, the support ring 120 comes into direct contact with the chamber insulator 110 and the suspension structure 130, but does not come into direct contact with the range top 140. In this example, the outer perimeter of the support ring 120 is greater than that of (1) the outer perimeter of the chamber insulator 110 and (2) the opening in the range top 140 through which the support structure 100 passes through. In some embodiments, the support ring 120 can be adapted to accommodate the particular shape of a wok or cooking pot.

In some embodiments, the support ring 120 can be made of hardy heat-tolerant material such as cast iron. Further, in some embodiments the chamber insulator 110 and the support ring 120 are joined by any conventional means of joining such materials. Additionally, in some embodiments the chamber insulator 110 and the support ring 120 may integrated into a single continuous structure composed of the same material. Further still, in some embodiments the portion of the chamber insulator 110 that extends above the range top 140 may be adapted to accommodate the particular shape of a wok or cooking pot. In embodiments where the chamber insulator 110 is modified to accommodate a wok or cooking pot, the support ring 120 and chamber insulator 110 are a single, continuous structure.

The support ring 120 and the chamber insulator 110 are suspended above the range top 140 by the suspension structure 130. In this example, the suspension structure includes a strap 132 that laterally encircles the tubular chamber insulator 110. The strap 132 may serve to increase rigidity and add structural support to the chamber insulator 110. The suspension structure also consists of a circular flange 180 that is in contact with and supportive of the chamber insulator 110. The suspension structure also consists of clips 134, 136 that extend upward perpendicular to the strap 132. The clips 134, 136 may be joined to the strap 132 by any conventional means of joining such materials. In this example, the strap 132 is joined to the clips 134, 136 with pop rivets 172, 174. Further, the clips 134, 136 may also be joined to the circular flange 180 by any conventional means of joining such materials. In this example, the circular flange 180 is joined to the clips 134, 136 with screws 173, 175. In this embodiment, the clips 134, 136 may be shaped in such a way that they contact the range top 140 and the circular flange 180 so that the only portion of the support structure that directly contacts the range top are the clips 134, 136 which suspend the support structure 100 above the range top 140. Further, the clips 134, 136 are constructed in such a way so as to minimize the amount of contact between the suspension structure 130 and the range top 140.

Also in this example, there is a gap 150 between the range top 140 and the support structure 100 which allows air to pass between the support structure 100 and the range top 140. Also in this example, there is a gap 152 between the support structure 100 and the chassis 160 which allows air to pass between the support structure 100 and the chassis 160. In this embodiment, the clips 134, 136 are shaped in such a way that they contact the range top 140, the support ring 120, and the circular flange 180. In other embodiments, the clips 134, 136 may be shaped in such a way that they contact the range top 140 and either the support ring 120, or the circular flange 180.

Another aspect of this embodiment is that the support structure 100 may be removably mounted to the range top 140 of the food preparation device. When the support structure 100 is removably mounted to the range top 140 of the food preparation device, the chamber insulator 110 is in direct contact with and supported by the circular flange 180. Further, when the support structure 100 is removably mounted to the range top of the food preparation device, the clips 134, 136 are in direct contact with the range top 140 but the chamber insulator 110 and support ring 120 are not in direct contact with the range top 140 or the chassis 160. Preferably, the clips 134, 136 are of a size and shape to minimize the amount of contact between the support structure 100 and the range top 140. For example, the width of the clips 134, 136 is about 1 to about 4 inches, thus minimizing the amount of area that is in contact with the range top 140. This effectively reduces the amount of heat transferred from the chamber insulator 110, the support ring 120, and the chassis 160, to the range top 140. One of ordinary skill in the art would know of other suitable configurations of the size or shape of the clips that may be used in accordance with the invention.

FIG. 2A is a depiction of the embodiment depicted in FIG. 4 from a different angle. In this figure, the gap 150 between the range top 140 and the support structure 100 can be seen in the area not obscured by the clips. The strap 132 and the circular flange 180 may also be seen in this figure. Also in this figure, the outer perimeter of the support ring 120 is greater than the perimeter of either (1) the chamber insulator 110 or (2) the opening in the range top 140 through which the support structure passes through when removably mounted to the range top 140 of the food preparation device.

This configuration protects against water and debris from passing below the range top 140 through the gap 150, while still allowing air to pass between the support structure 100 and the range top 140.

FIG. 3 is a view of a preferred embodiment of a suspension structure 200. In this example, a suspension structure 200 includes a strap 232 that encircles the tubular chamber insulator. The strap 232 may serve to increase rigidity and structural support of the chamber insulator. The suspension structure 200 further consists of a circular flange 280 that is in contact with the bottom edge of the chamber insulator that may support the chamber insulator and support ring. The suspension structure 200 also consists of clips 234, 236, 238 that extend upward and downward, perpendicular to the circular strap 232. In this embodiment, three clips 234, 236, 238 are situated equidistant from one another around the strap. One of ordinary skill in the art would know of other suitable configurations of the size or shape of the clips that may be used in accordance with the invention. Preferably, the elements of the suspension structure 200 are made of hardy heat-tolerant material. An example of a suitable material includes, but is not limited to, stainless steel. Alternative materials could consist of hardy, heat-tolerant material that is less heat-conductive than stainless steel. One of ordinary skill in the art would know how to use other suitable heat sources in accordance with the invention. The clips 234, 236, 238 may be joined to the strap 232 by any conventional means of joining such materials. In this example, the clips 234, 236, 238 are joined to the strap 232 with pop rivets 272, 274, 276. Further, the clips 234, 236, 238 may also be joined to the circular flange 280 by any conventional means of joining such materials. In this example, the clips 234, 236, 238 are joined to the circular flange 280 with screws 273, 275, 277.

While the foregoing written description of the invention enables one of ordinary skill to make and use what is considered presently to be the best mode thereof, those of ordinary skill will understand and appreciate the existence of variations, combinations, and equivalents of the specific embodiment and examples herein. The invention should therefore not be limited by the above described embodiment and examples, but by all embodiments within the scope and spirit of the invention as claimed.

The invention claimed is:

1. A High Temperature Food Preparation Device comprising:

a) a chassis, said chassis comprising a base with a bottom wall and side walls, each of said walls having an inner and an outer surface, said side walls extending upwards from said bottom wall;

b) a range top joined to said side walls of said chassis, said range top having at least one cooking station, each of said cooking stations comprising a circular opening, whereby said range top is cooled by air and not by water during high-temperature cooking operations;

c) a heat source joined to said chassis;

d) a fully removable support structure capable of withstanding a temperature exceeding 500° F., said fully removable support structure positioned in at least one range top circular opening, said support structure is not fastened to the range top, not in contact with any inner surface of said chassis, not coupled to said heat source and not coupled to a support for said heat source;

e) one or more suspension clips that position said support structure in one of said circular range top openings so that said support structure does not contact said range top other than through said suspension clips thereby creating a plurality of open spaces between said range top and said removable support structure, wherein air is permitted to freely flow;

f) said fully removable support structure comprises a single tubular chamber insulator, said tubular chamber insulator having an outer diameter that is smaller than the inside diameter of said cooking station circular opening, said tubular chamber insulator is sized such that when said removable support structure is positioned in one of said cooking station circular openings, the lowest most part of said removable support structure fully encompasses said heat source without contacting any surface of said chassis; and g) said fully removable support structure further comprises a support ring located adjacent to said tubular chamber insulator that extends above and beyond the outer diameter of said circular opening in the range top without touching said range top, said support ring prevents food, cooking materials, and debris from entering the area below the range top through said open spaces between said range top and said removable support structure;

wherein when said removable support structure is removed from said high-temperature food preparation device, there is no structure projecting down from said range top within said high-temperature food preparation device that conducts heat to said range top, and other than the heat source, there is no structure that precludes access to the interior surface of said chassis bottom wall.

2. The High Temperature Food Preparation Device of claim 1 tubular chamber insulator further comprising a wall thickness of between about 0.03 and about 2 inches.

3. The High Temperature Food Preparation Device of claim 1 tubular chamber insulator further comprising a wall thickness of between about 1 and about 1.5 inches.

4. The High Temperature Food Preparation Device of claim 1 further comprising a strap that laterally encircles the tubular chamber insulator.

5. The High Temperature Food Preparation Device of claim 1 further comprising a substantially equidistant spacing between said suspension clips.

6. A High Temperature Food Preparation Device comprising:

a) a chassis, said chassis comprising a base with a bottom wall and side walls, each of said walls having an inner and an outer surface, said side walls extending upwards from said bottom wall;

b) a range top joined to said side walls of said chassis, said range top having at least one cooking station, each of said cooking stations comprising an opening, whereby said range top is cooled by air and not by water during high-temperature cooking operations;

c) a heat source joined to said chassis;

d) a fully removable support structure capable of withstanding a temperature exceeding 500° F., said fully removable support structure positioned in at least on range top opening, said support structure comprises a single chamber insulator, said chamber insulator having an outer diameter that is smaller than the inside diameter of said cooking station opening, said chamber insulator is sized such that when said removable support structure is positioned in one of said cooking station openings, the lowest most part of said removable support structure fully encompasses said heat source without contacting or being fastened to any surface of said chassis;

e) a plurality of suspension clips that position said support structure in one of said range top openings so that said support structure does not contact said range top other than through said suspension clips thereby creating a plurality of open spaces between said range top and said removable support structure, wherein air is permitted to freely flow; and f) said fully removable support structure further comprises a support ring located adjacent to said tubular chamber insulator;

wherein when said removable support structure is removed from said high-temperature food preparation device, there is no structure projecting down from said range top within said high-temperature food preparation device that conducts heat to said range top, and other than the heat source, there is no structure that precludes access to the interior surface of said chassis bottom wall.

* * * * *